United States Patent [19]

Rivera

[11] Patent Number: 4,833,784

[45] Date of Patent: May 30, 1989

[54] METHOD AND APPARATUS FOR MECHANICALLY MARKING LOTTERY OR OTHER GAMES

[76] Inventor: Rafael Rivera, 43 Simplex Ave., New Brunswick, N.J. 08901

[21] Appl. No.: 228,042

[22] Filed: Aug. 4, 1988

[51] Int. Cl.[4] ..... B43I 13/00

[52] U.S. Cl. ..... 33/18.1

[58] Field of Search ..... 283/903; 33/18, 23.02, 33/23.01, 23.04, 18.2, 18.3, 19.3, 20.1, 21.1, 45, 32.1, 26; 434/363, 364

[56] References Cited

U.S. PATENT DOCUMENTS

| | | |
|---|---|---|
| 1,351,762 | 9/1920 | King . |
| 1,775,813 | 9/1930 | Colby . |
| 2,633,638 | 4/1953 | Metzner . |
| 3,417,472 | 12/1968 | Nelson . |
| 3,855,707 | 12/1974 | Traylor . |

*Primary Examiner*—Harry N. Haroian

*Attorney, Agent, or Firm*—Martha G. Pugh

[57] ABSTRACT

This invention relates to devices which can be mechanically actuated by the user for marking lottery and other game cards to indicate selected numbers. A shallow elongated container is provided in which the card to be marked is fixed in place. A U-shaped yoke fastened at one end of the container functions to pivotally support a tubular sleeve, which rotates up and down through a small angle against a spring bias. A shaft is interposed to be moved slideably in the sleeve in the lengthwise direction of the container. The shaft terminates at its inner end in a marking head, which is pivotally connected to move in a horizontal plane. A rod depending from the marking head supports stamping means which is constructed, when inked and depressed, to make an impression on the card to indicate a selected number. In one embodiment, the ink is stored in the marking head, and passes to the stamping means through a wick. In another embodiment, the marking head is solid; and the stamping means is inked by application to an ink pad, prior to being depressed to make a mark. Both embodiments include an additional container for storing spare cards.

7 Claims, 4 Drawing Sheets

METHOD AND APPARATUS FOR MECHANICALLY MARKING LOTTERY OR OTHER GAMES

BACKGROUND OF THE INVENTION

This relates in general to mechanically actuated marking devices, and more particularly, to devices which can be manipulated by players for marking lottery cards.

Many States, local communities and private charitable organizations use lotteries and other card games for fund drives. The printed cards conventionally used for lottery cards require that a number of rectangular spots be blackened to indicate the player's selection of a series of numbers in each of several categories, which may be time consuming when people are in a hurry to play or select desired numbers. Moreover, it is important that these markings be uniformly black in order to facilitate computerized calibration, such as with lottery cards.

SHORT DESCRIPTION OF THE INVENTION

It is therefor the principal object of the invention to facilitate the marking of lottery cards, and to provide a product which is adapted to be readily calibrated or recorded by computerized means.

These and other objects are realized in the mechanical marking device of the present invention. This comprises an elongated flat-bed housing which is shaped to accommodate and secure in place the cards to be marked. Centered on a supporting platform at one end of the housing is a U-shaped yoke pivotally supporting a tubular sleeve. The latter is rotatable through a small arc in a vertical plane normal to its axis, and is journaled on bearings to move and up and down against a spring bias. A shaft having a free end is mounted to move slideably back and forth in an axial direction in the tubular sleeve. The shaft terminates at its inner end in a pivotally mounted stamping head which is constructed to rotate through a small arc in a plane substantially parallel to the plane of the card. Depending near the end of the head is a rod or tube, terminating in a stamping member.

In a preferred embodiment, an ink reservoir, including a wick, is stored in the head of the stamping member, so that when the shaft is shifted to a desired position on the lottery card, it can be depressed against the spring bias, making an ink impression on the card.

In another embodiment, an ink pad is mounted across one end of the flat bed, to enable the shaft to be shifted to a first position to enable the stamp pad to be linked, and subsequently, to a second position to make an ink impression on the lottery card.

The operation can be repeated by moving the stamping member to different positions on the card until all the selected numbers are stamped.

As an additional feature, the housing comprises a compartment beneath the flat bed, in which a supply of spare cards may be stored, or in the alternative embodiment, an ink bottle may also be stored.

These, and other objects, features, and advantages will be understood from a study of the specification hereinafter with reference to the attached drawings.

SHORT DESCRIPTION OF THE DRAWINGS

FIG. 7 is an exploded view of an alternative embodiment of the apparatus of the present invention.

DETAILED DESCRIPTION OF THE INVENTION

Figure 1:
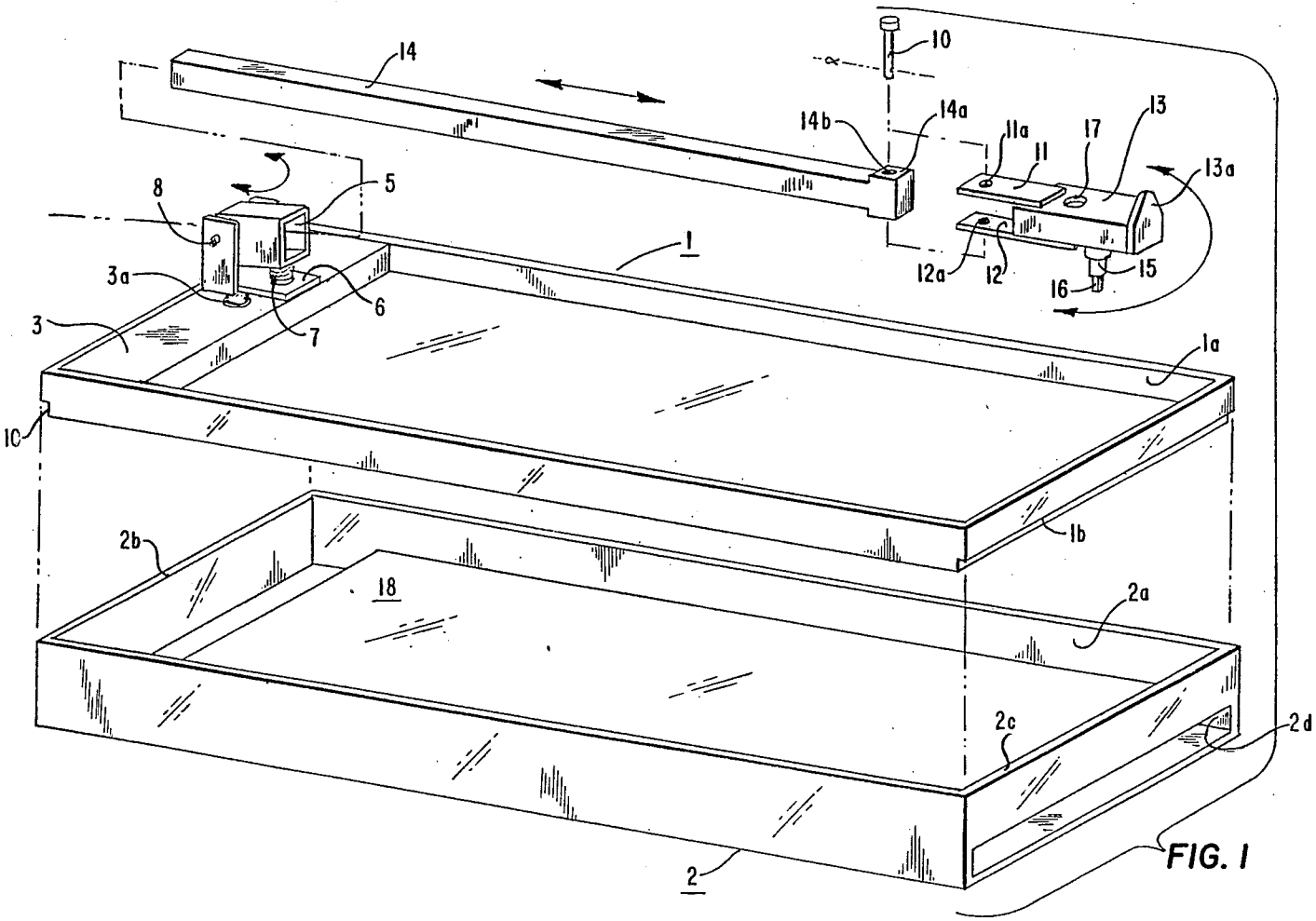
FIG. 1 shows, in perspective, an exploded view of a preferred embodiment of the apparatus of the present invention for mechanically marking lottery cards, with the shaft removed from the yoke, and the stamping pad removed from the shaft.
Figure 2:
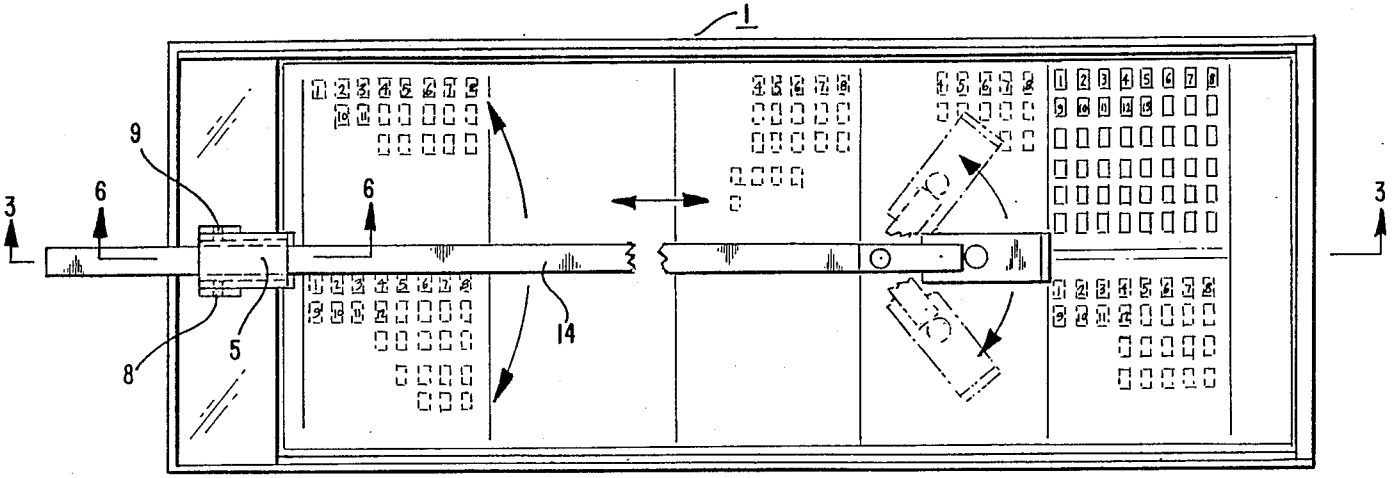
FIG. 2 is a top view of a preferred embodiment of the present invention with a lottery card in place for marking.
Figure 3:
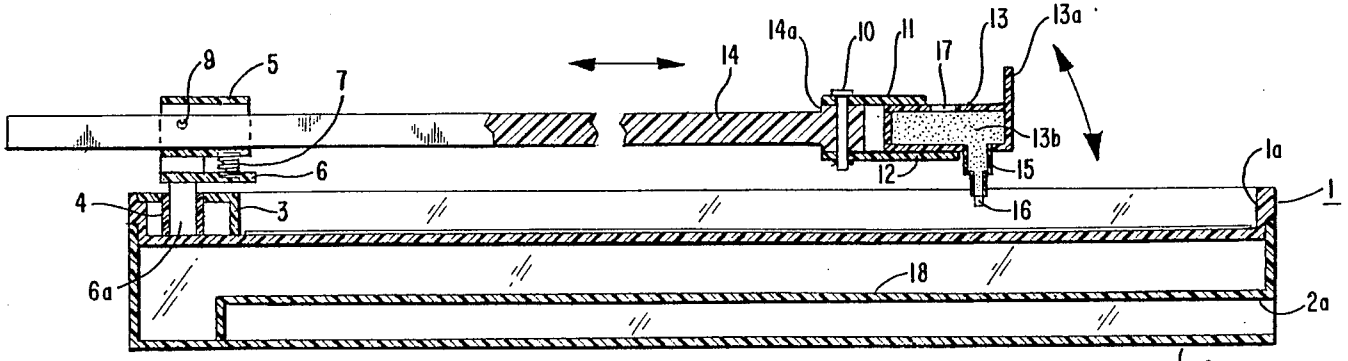
FIG. 3 is a longitudinal section through the plane indicated by the arrows 3—3 of FIG. 2.
Figure 4:
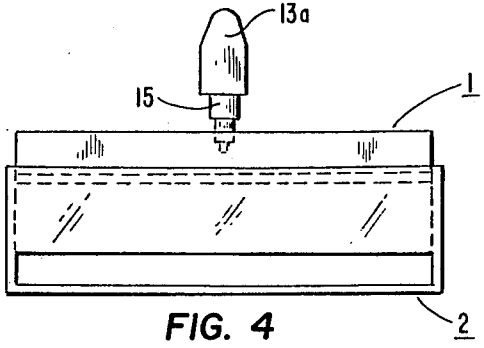
FIG. 4 is an end elevation of the stamping head end of the embodiment of FIGS. 1–3.
Figure 5:
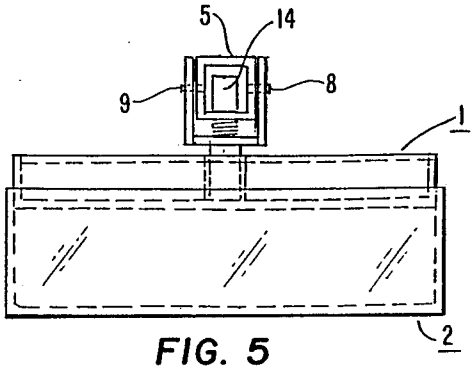
FIG. 5 is an end elevation of the yoke end of the embodiment of FIGS. 1–4.

Referring to the exploded view shown in FIG. 1, and the views of FIGS. 2, 3, 4 and 5, which respectively show the top, longitudinal section and ends of the device of the present invention, there is shown a shallow rectangular container 1, say, 9.7 inches long, 3.8 inches wide, and ½ inch deep overall. This container having wall thicknesses, say, 1/16 inch thick, accommodates slideably on its upper surface a shallow rectangular cavity 1*a*, 9¾ inches long, and 3½ inches wide which just accommodates flush with one end, a supporting platform 3, which is 3.4 inches across the width, and extends 0.7 inch forward from the end wall.

The end walls of the base of 1 are slightly cut back to form notches, 1*b* and 1*c* along the long bottom edges, so that the top container 1 rests on and mates with the top edges 2*b* and 2*c* of lower chamber 2. The latter is 10 inches long, 3.8 inches wide, and 1.2 inches in overall depth. This has a rectangular inner cavity 2*a* which is 9 inches long and 3.6 inches wide, and say, ½ inch deep.

A rectangular slot 2*d*, 3¾ inches wide across one end, and 0.4 inch high, is formed across one end of chamber 2 to provide for the insertion and removal of a supply of lottery cards, conventionally 3¼ inches by 8½ inches, to be used as replacements. The chamber 1 and chamber 2 are formed of any well-known solid construction material, such as any of the well-known rigid plastics, for example, high density polyethylene, or a product known by the trademark "LUCITE", or alternatively, wood or sheet metal.

Centered in the supporting platform 3 is a cylindrical socket 3*a* which is, say ¼ inch in diameter and ⅜ inch deep. This serves as a mounting for a rod 6*a*, which is, say, just under ¼ inch in diameter and, say ½ inch long, fixed in place in the socket 3*a*. The flat tongue 6, which is, say, 0.8 inch long, and 0.6 inch wide, and 1.16 inch thick, is supported on top of the rod 6*a*, the upper end of which is fixed about ⅛ inch from the rear edge, permitting the front end of tongue 6 to tip forward with a toggle effect.

Figure 6:
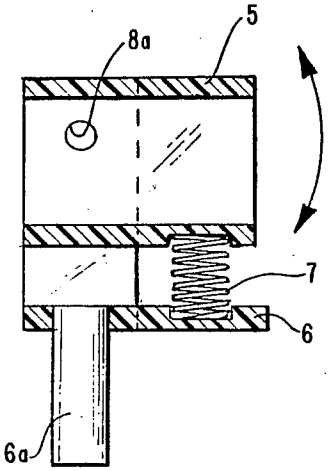
FIG. 6 is an enlarged section along the plane indicated by the arrows 6—6 of FIG. 5 of the yoke of FIGS. 1, 2, 3 and 5.

A pair of side walls, 8 and 9, each ⅜ inch wide and 3.4 inch high, are fixed to opposite rear lateral edges of the platform 6 to form a U-shaped yoke. Centered about 0.2 inch below the respective top edges of side walls 8 and 9 are bearing holes 8*a*, 9*a* which are, say, 0.2 inch in diameter. (See FIGS. 5 and 6).

A tubular sleeve 5 having sidewalls 1/16 inch thick, has a rectangular bore, say, 0.3 inch across the top, and 0.4 inch on the sides, and 0.7 inch from front to rear.

Tubular sleeve 5 is supported between side walls 8 and 9 of the U-shaped yoke by pivots which extend laterally from its opposite sides, and respectively rest rotatably in the bearings 8*a*, 9*a*. Thus, tubular sleeve 5 is slightly rotatable, forward and back, against the compression of the coil spring 7 which depends from the under surface of its front end, and is fixed to the front end of tongue 6.

A shaft 14 is, say, 9½ inches from end to end, and has a rectangular section, say, 0.2 inch by 0.3 inch, so that it moves back and forth slideably in the tubular sleeve 5. The opposite end 14*b* of the shaft 14 terminates in a rectangular knob 14*a* of slightly larger section, which has a bore 14*b*, say, 0.2 inch in diameter, which extends through the knob 14*a* from top to bottom.

A hollow head portion 13, also of rectangular section, is 2.2 inches long, 0.4 inch wide, and ½ inch deep, terminating in a flange 13*a*, say, ⅛ inch wide which projects about 0.2 inch above the front end.

The hollow interior chamber of the head 13 (See FIG. 3), is filled with absorbent material, such as sponge rubber, which functions as a reservoir for black ink, which is introduced through a round opening 17, say, 0.2 inch in diameter, near the center of the upper surface.

The head 13 terminates at its inner end in a pair of rectangular rearwardly-extending flanges 11 and 12, say, 6 inches long and ⅜ inch wide, at the top and bottom, which accommodate the knob 14*a* between them. Each of flanges 11 and 12 has a central bore. A bolt 10 passes through the bores to fasten flanges 11 and 12 in pivotal relation to the knob 14*a* at the end of shaft 14, so that the head 13 is rotatable through an arc in the horizontal plane about the end of shaft 14.

Depending vertically an overall distance of about ½ inch from the under surface of the head 13 is a tubular member 15 filled with sponge rubber, which serves to channel the ink from the reservoir 13*b* into a porous resilient rubber stamp at its lower end, which may, for example be rectangular in shape, 0.15 inch by 0.1 inch. This serves to make a small rectangular black ink impression at a selected spot on a lottery card in place in the shallow container 1*a*, when the shaft and head have been moved into place.

The modification shown in FIG. 7 differs from the embodiment described with reference to FIGS. 1 et seq., in that the head 23 is solid; and the rubber stamping member 26 is inked by moving the shaft 34 back through the tubular sleeve 25 until it is position to be pressed against the ink pad 40. The latter, which is, say, 1¼ inches long, 0.2 inch wide and 0.3 inch thick, is disposed adjacent the platform 23. Once the stamp has been inked, the user may proceed as with the device of FIG. 1 to move the shaft 34 forward, rotating the head 23 in position over the spot to be marked.

The container 22 is substantially deeper than the container 2 of FIG. 1, say, about 2¼ inches deep, and may have a rear compartment which accommodates an ink refill bottle 41. Except for the features just mentioned, the device of FIG. 7 is substantially the same as that shown and described with reference to FIG. 1. It will be noted that 20 has been added to the designating numbers of corresponding elements in the latter.

Although two embodiments have been described by way of example, it will be understood that the present invention is not restricted to the forms shown by way of example, but only by the recitations of the appended claims.

What I claim is:

1. A device for marking lottery and other game cards which comprises in combination:

an elongated container constructed to hold one said card in a substantially fixed position in a first horizontal plane;

a yoke comprising bearing means mounted on supporting means substantially centered adjacent to one end of said elongated container;

a tubular sleeve pivotally mounted in said bearing means for slight rotation in a substantially vertical plane;

spring-biasing means connected between said tubular sleeve and said supporting means for imposing a spring-bias on the up and down pivotal movement of said sleeve member;

an elongated shaft interposed to move back and forth slideably in said tubular sleeve in the longitudinal direction of said container;

a marking head pivotally attached to one end of said shaft, said marking head constructed to be moved rotatably about the end of said shaft in a second plane substantially parallel to said first horizontal plane;

a rod depending from said marking head in a direction substantially normal to the principal axis of said marking head;

said rod terminating in stamping means constructed to make an imprint on said card;

means for supplying ink to said stamping means;

whereby said shaft is constructed to be manipulated by the user to slide back and forth in said tubular sleeve until said marking head is roughly adjacent the position to be marked on said card, and said stamping means is then rotated to the desired position in said second plane and depressed to imprint a stamp mark at a selected position on said card.

2. The combination in accordance with claim 1 wherein:

said yoke is U-shaped;

said tubular sleeve has a bore of substantially rectangular cross-section; and said elongated shaft interposed to move back and forth slideably in said tubular sleeve has a substantially rectangular cross-section.

3. The combination in accordance with claim 1 for marking lottery cards having squares to be filled in to indicate selected numbers, wherein said stamping means comprises a rectangularly-shaped ink pad shaped to make an imprint to substantially conform to the boundaries of the squares on said lottery cards.

4. The combination in accordance with claim 1 wherein said elongated container comprises a shallow rectangular top portion constructed to accommodate in slideable relation the immediate card in the process of being marked, and wherein said top portion serves as a closure for a deeper under chamber having a lateral opening for the storage of spare cards.

5. The combination in accordance with claim 1 wherein said marking head comprises a chamber, and said rod terminating in said stamping means communicates with said chamber, and communicates with means for feeding ink from said chamber into said stamping means.

6. The combination in accordance with claim 1 wherein said marking head and said rod are solid, and said elongated container encloses an ink pad near one end, whereby said shaft and said marking head are first manipulated by a user to contact said ink pad prior to changing the position of said shaft and said marking head to make imprints on selected squares on said card.

7. The method of marking lottery cards to indicate selected numbers which comprises the steps of:

placing a lottery card to be marked in a substantially fixed position on a first horizontal plane in a shallow container;

selecting the spot to be marked on said lottery card;

manipulating a mechanical stamping device comprising a shaft interposed slideably in a tubular sleeve fixed at one end of the container to align a marking head connected to said shaft with the longitudinal position of said spot;

rotating a stamping head of said device in a horizontal plane substantially parallel to said first plane until said stamping head is positioned directly over said spot; and depressing said stamping head to imprint a mark on said spot.

* * * * *